US005148857A

United States Patent [19]

Kato et al.

[11] Patent Number: 5,148,857

[45] Date of Patent: Sep. 22, 1992

[54] METHOD FOR REMOVING SOOT BY SCATTERING STEEL BALLS IN A HEAT-EXCHANGER AND HEAT-EXCHANGER PROVIDED WITH A STEEL BALL SCATTERER

[75] Inventors: Masami Kato; Tadashi Tanaka; Satoshi Nakamura, all of Nagoya; Tsuneo Higashi; Hiroshi Fujike, both of Mihara; Katsuaki Makino; Hiroshi Miyamoto, both of Hiroshima, all of Japan

[73] Assignees: Chubu Electric Power Company, Inc., Aichi; Mitsubishi Jukogyo Kabushiki Kaisha, Tokyo, both of Japan

[21] Appl. No.: 703,774

[22] Filed: May 21, 1991

[30] Foreign Application Priority Data

May 21, 1990 [JP] Japan ..... 2-52147[U]
May 21, 1990 [JP] Japan ..... 2-129292

[51] Int. Cl.[5] ..... F28G 13/00

[52] U.S. Cl. ..... 165/1; 165/95; 134/7

[58] Field of Search ..... 134/6-8; 165/1, 95

[56] References Cited

U.S. PATENT DOCUMENTS 2,665,118 1/1954 Broman ..... 165/95
2,665,119 1/1954 Broman ..... 165/95 X
2,809,018 10/1957 Broman ..... 165/95
2,949,282 8/1960 Kirkby ..... 165/95
2,962,264 11/1960 Enerus ..... 165/95
4,203,778 5/1980 Nunciato et al. ..... 134/7
4,886,112 12/1989 Vinson ..... 165/95

FOREIGN PATENT DOCUMENTS 2818006 8/1979 Fed. Rep. of Germany .
2142407 1/1985 United Kingdom .

*Primary Examiner*—Allen J. Flanigan
*Attorney, Agent, or Firm*—Wenderoth, Lind & Ponack

[57] ABSTRACT

A method for removing soot or the like adhered to heat transfer tubes of a heat exchanger by providing a steel ball scatterer above the heat transfer tubes and intermittently scattering steel balls towards the heat transfer tubes. The improvements reside in that the steel ball scattering rate is set to a small initial rate at the commencement of the scattering operation and thereafter is increased either in a stepwise manner or continuously. Preferably, within a main body casing of the heat exchanger, a plurality of steel ball collision preventing plates having their central portions extending convexly upwards are provided between the steel ball scatterer and the heat transfer tube group, in order to prevent fins of the heat transfer tubes from being damaged by steel balls falling from the steel ball scatterer and directly colliding against the fins.

2 Claims, 7 Drawing Sheets

AMOUNT OF CHANGE
OF PLATE THICKNESS

METHOD FOR REMOVING SOOT BY SCATTERING STEEL BALLS IN A HEAT-EXCHANGER AND HEAT-EXCHANGER PROVIDED WITH A STEEL BALL SCATTERER

BACKGROUND OF THE INVENTION

1. Field of the Invention

The present invention relates to a method for removing soot or the like adhered to surfaces of heat transfer tubes in a heat exchanger of an exhaust gas economizer or the like by scattering steel balls, and a heat exchanger provided with a steel ball scatterer.

2. Description of the Prior Art

In order to remove soot or the like adhering to surfaces of heat transfer tubes in a heat exchanger or an exhaust gas economizer or the like, a heat exchanger having a steel ball scattering device assembled therein has heretofore come into practical use. FIG. 1 is a general vertical cross-sectional view of one example of such a heat exchanger in the prior art, and FIG. 2 is a perspective view, partly cut away, of the same heat exchanger.

In these figures, reference numeral 1 designates a main body casing of a heat exchanger, in which heat transfer tube groups 2 are disposed and steel ball scatterers 3 are provided above (upstream of) the heat transfer tube groups. To these steel ball scatterers 3 are fed steel balls from a steel ball feeder 4. The steel balls scattered by the steel ball scatterers 3 fall while removing soot or the like adhered to the heat transfer tube groups 2. Then they are returned to the above-mentioned steel ball feeder 4 by a steel ball conveyor 5. Reference numeral 6 designates a gas inlet, and numeral 7 designates a gas outlet. The gas inlet 6 is provided at one end of the heat exchanger main body 1 above the steel ball scatterers 3, and the gas outlet 7 is provided at one side portion of the heat exchanger main body 1 at a level lower than that at which the heat transfer tube groups 2 are disposed.

FIG. 3 is a perspective view of one example of the steel ball scatterer 3, and in this figure, reference numeral 3*a* designates a steel ball feed pipe having a square cross section and numeral 3*b* designates a scattering plate, whose upper surface is spherical. The number of steel ball scatterers 3 disposed within the heat exchanger is determined depending upon the projected cross-sectional area of the heat transfer tube groups and the area over which one steel ball scatterer can scatter steel balls. If the steel ball scattering area of one steel ball scatterer is broad, the number of steel ball scatterers can be small.

When removing soot or the like adhered to surfaces of heat transfer tubes in a heat exchanger of an exhaust gas economizer or the like, by scattering steel balls with the above-described steel ball scattering device, the rate and method of scattering the steel balls are regulated depending upon the amount of soot or the like adhered to the heat transfer tubes. More particularly, in the case where the adhered amount is great (an adhering rate is large), unless steel balls are continuously scattered at a large rate, the adhered amount of soot or the like would increase and a predetermined heat transfer performance cannot be maintained. On the other hand, in the case where the adhered amount is little, a heat transfer performance could be maintained even if the scattering rate is small or even if an intermittent scattering at long time intervals is effected.

In addition, the scattering range and scattering height of the steel ball scatterer are, in the case of the spherical surface type scatterer shown in FIG. 3, represented by the following equations:

$$\text{scattering range } x = \eta \cdot vo \cdot \cos\Theta \cdot t$$

$$\text{scattering height } y = \eta \cdot vo \cdot \Theta \cdot t - \tfrac{1}{2} i \cdot t^2$$

where $\eta$: restitution coefficient between a steel ball and the scattering plate, vo: velocity of a steel ball when it collides with the scattering plate, $\eta$: angle (with respect to the horizontal direction.) of a trajectory of a steel ball flying out of the scatterer, t: time elapsed after collision, and g: acceleration by gravity.

As will be seen from these equations, a scattering range as well as a scattering height are related to the velocity (vo) of a steel ball when it collides with a scattering plate. (This collision velocity (vo) is proportional to the square root of the height from which the steel ball experiences free fall.) Accordingly, as steel balls are dropped onto a scattering plate from a higher position, the steel balls can be scattered over a broader range.

In the case of removing soot by the intermittent scattering of steel balls, the soot or the like once freed from the heat transfer tubes would scatter simultaneously with a subsequent scattering of the steel balls, and so, the concentration of soot and the like in the exhaust gas would be temporarily increased. Generally, an electric dust collector is disposed on the downstream side of a heat exchanger, and if its dust collecting power is insufficient, soot or the like would be released into the atmospheric air, and the atmospheric air would be contaminated. Therefore, to accommodate for an abrupt increase in soot concentration in the exhaust gas as described above, it is necessary to provide an electric dust collector having a fairly large capacity, thus contributing to the overall scale of the apparatus.

In addition, in the method for removing soot by scattering steel balls as described above, since the steel balls are made to directly collide with the heat transfer tubes, the heat transfer tube fins are inevitably damaged. FIG. 4 is a longitudinal cross-sectional view of part of a finned heat transfer tube 8, and FIG. 5 is a transverse cross-sectional view of the same. With reference to these figures, a top portion of a fin 8*b* mounted to a pipe 8*a* is damaged and deformed by collision with a falling steel ball as shown at 8*c* in FIG. 4. The degree of damage depends upon the velocity of the steel ball, i.e., the larger the velocity, the greater the damage. The velocity at which a steel ball will collide against a fin depends upon the height from which the steel ball free falls as described above, and upon the height from which the steel ball is scattered. A broadening of the scattering range of steel balls by a steel ball scatterer is necessarily accompanied by an increase in the scattering height and thus in the damage to the fins. However, if damage to the fins is lessened by narrowing the scattering range of the steel balls, a large number of steel ball scatterers must be provided which may be practically impossible.

SUMMARY OF THE INVENTION

It is, therefore, one object of the present invention to provide a novel method for removing soot by scattering steel balls in a heat exchanger, by which an abrupt increase of soot or the like in exhaust gas can be mitigated. Hence, the capacity of a peripheral instrument, such as an electric dust collector, can be relatively small so that installation space and expenses can be saved.

Another object of the present invention is to provide an improved heat exchanger provided with a steel ball scatterer, in which the damage of fins on heat transfer tubes can be suppressed to a minimum without deteriorating steel ball scattering characteristics, whereby the life of the heat transfer tubes can be greatly prolonged.

According to the present invention, there is provided an improved method for removing soot or the like adhered to heat transfer tubes of the heat exchanger by intermittently scattering steel balls towards the heat transfer tubes, the improvement residing in that the rate at which the steel balls are scattered is set at a small initial rate at the commencement of the scattering operation and is thereafter increased.

A steel ball scatterer can be provided above the heat transfer tubes to effect the intermittent scattering of the steel balls towards the heat transfer tubes.

According to still another feature of the present invention, there is provided an improved heat exchanger having a heat transfer tube group and a steel ball scatterer disposed above the heat transfer tube group within a main body casing through which gas containing soot and dust flows, the improvement residing in that a plurality of steel ball collision preventing plates having their central portions extending convexly upwards are provided between the steel ball scatterer and the heat transfer tube group.

According to the present invention, as featured above, the rate at which steel balls are scattered for the purpose of removing soot is set to be small at the commencement of scattering in each period during an intermittent scattering operation. Thereafter, the rate is increased either in a stepwise manner or continuously. During the overall operation, a predetermined amount of steel balls are scattered. Therefore, soot or the like adhered to the heat transfer tubes is gradually removed in a manner in which the concentration of soot discharged in the exhaust gas will not rise abruptly. Accordingly, the capacity of an associated electric dust collector can be small (whereby the dust collector provided can be relatively inexpensive.)

Also, according to the present invention, owing to the above-described structural features of the heat exchanger, falling steel balls will collide against the steel ball collision preventing plates and will not directly collide with the upper portions of the heat transfer tubes. Therefore, damage to the heat transfer tubes can be prevented. In addition, since the central portions of the steel ball collision preventing plates extend convexly upwards, the density of the scattered steel balls can be maintained uniform.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1:
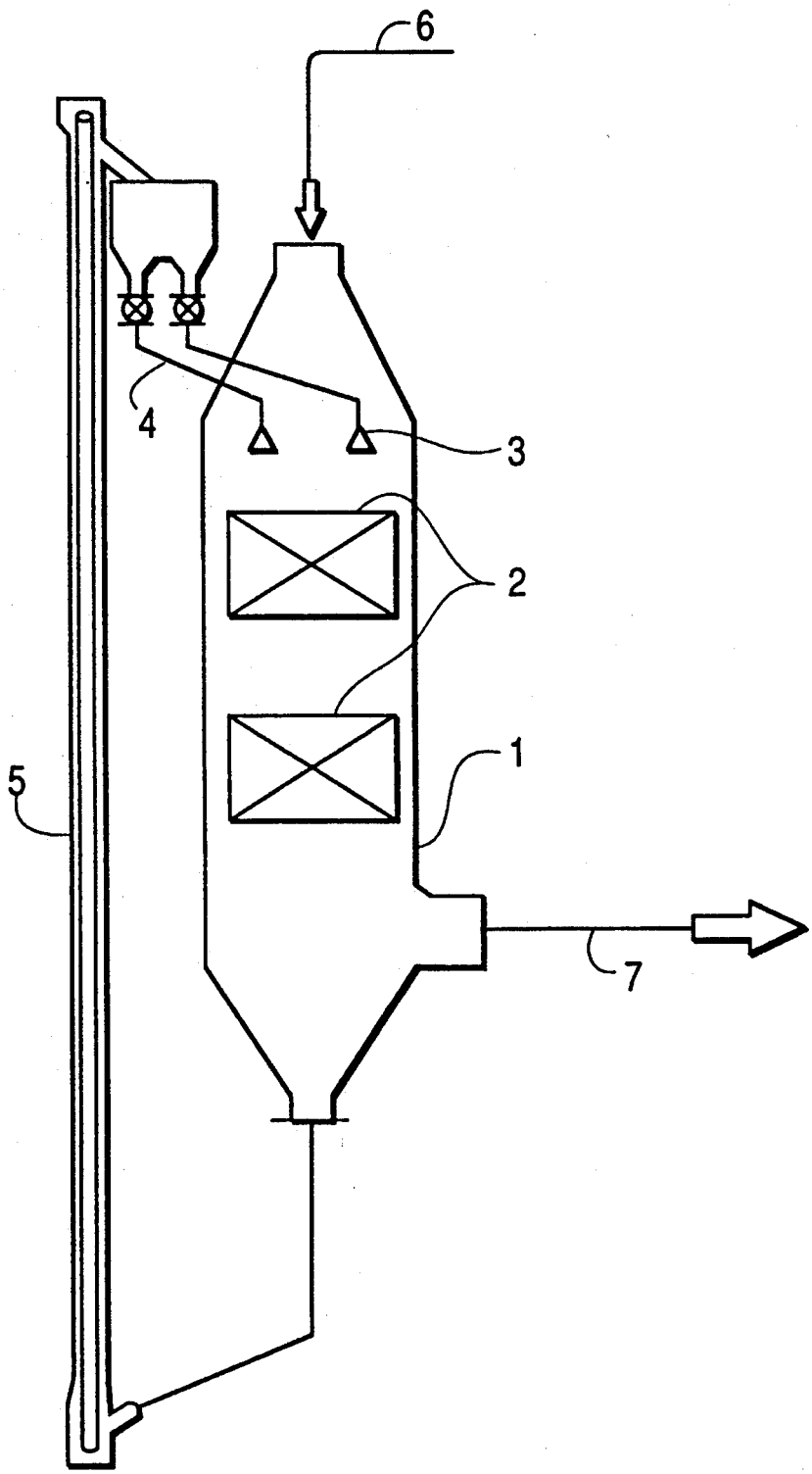
FIG. 1 is a general vertical cross-sectional view of a heat exchanger in the prior art.

Now a first preferred embodiment of the method according to the present invention will be described in greater detail. The first preferred embodiment is practiced by making use of the apparatus shown in FIG. 1. In this figure, at first, gas containing soot or the like is introduced through the gas inlet 6, and after the gas has undergone a heat exchange at the heat transfer tube group 2, it is made to flow out through the gas outlet 7. Soot or the like adheres to the heat transfer tubes in the heat transfer group 2, and would tend to degrade the heat transfer performance of the tubes. When the heat transfer performance has been degraded to a certain extent, steel balls are scattered for the purpose of restoring the heat transfer performance. A low scattering rate is chosen at the time the scattering operation commences. Thereafter, the scattering rate is increased either in a stepwise manner or continuously by regulating a rotational speed of a rotary ejector associated with the steel ball feeder. And eventually, a predetermined amount of steel balls are scattered to recover the heat transfer performance.

Figure 6:
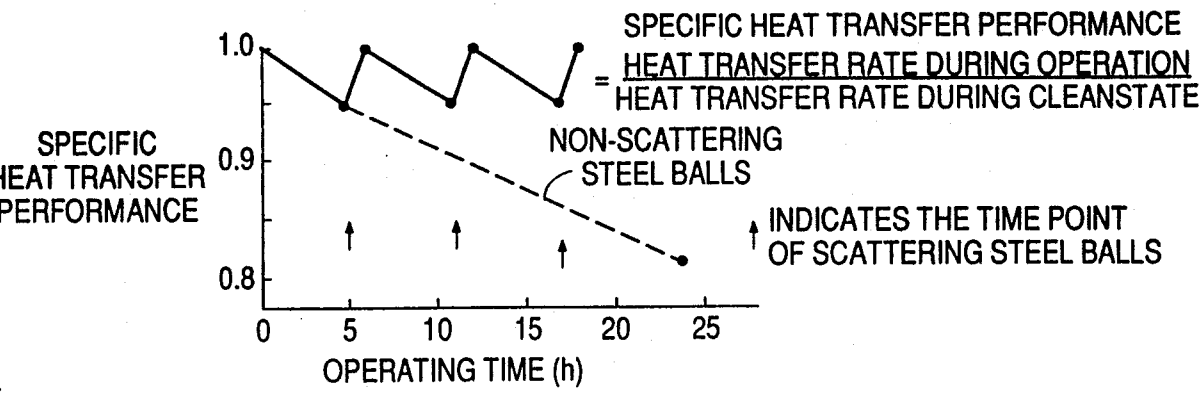
FIGS. 6 and 7 are diagrams showing effects and advantages of the present invention.
Figure 7:
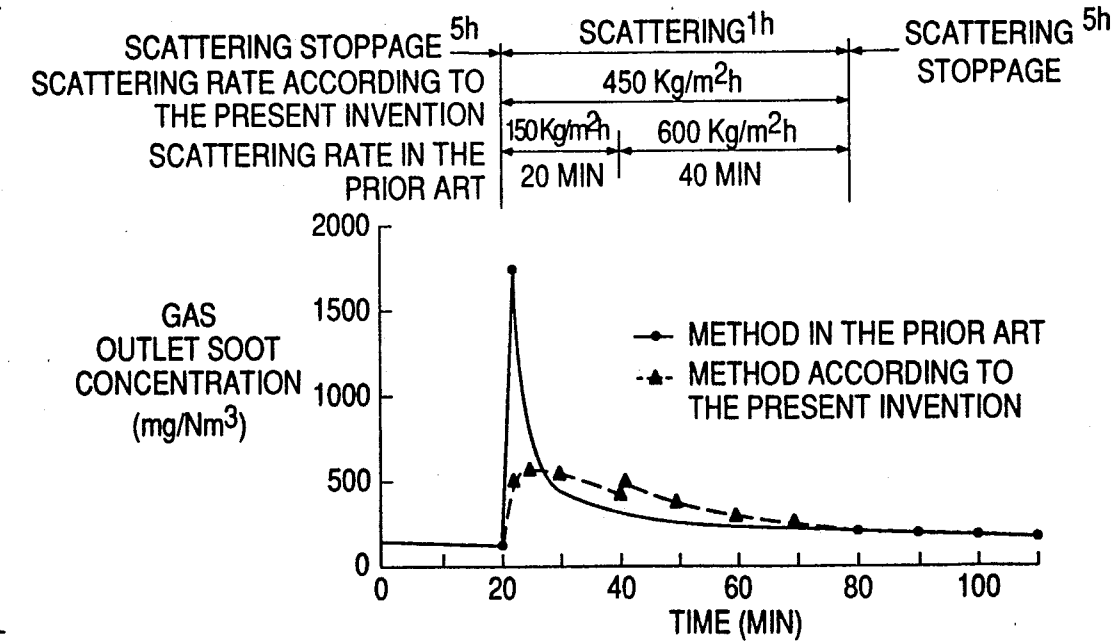

One preferred embodiment of the present invention has been applied to a coal-fired boiler, under the following conditions:

1) Inflow exhaust gas conditions
   (a) gas flow rate : 9400 $Nm^3/h$
   (b) concentration of soot or : 150 $mg/Nm^3$ the like
   (c) temperature :
      inlet 130° C. and
      outlet 90° C.
2) Apparatus specification
   (a) heat transfer tube specification
      tube diameter: 34 mm, thickness: 3.2 mm
      fin diameter : 64 mm, thickness: 1.6 mm
      fin pitch : 2.5 fins/in
   (b) heat transfer area: 82 $m^2$
   (c) horizontal cross-sectional area of apparatus: 1 $m^2$ As a result of carrying out the method of the present invention under such conditions, the heat transfer performance of the heat transfer tubes changed as shown in FIG. 6. More particularly, in the case of not scattering steel balls, a specific heat transfer performance is lowered to 0.82 in 24 hours as shown by a dashed line in FIG. 6. In the case where steel balls (5 mm in diameter) were scattered at a rate of 450 $kg/cm^2h$ once every 6 hours, each time for one hour, through the heretofore known method, a specific heat transfer performance was maintained at 0.95–1.0 as shown by solid lines in FIG. 6. However, the concentration of soot in the exhaust gas immediately after the commencement of the scattering operation amounted to 1700 mg/Nm$^3$ which is about 17 times as large as the concentration (about 100 mg/Nm$^3$) when the scattering operation is stopped, as shown in FIG. 7.

Next, as one preferred embodiment of the present invention, steel balls were scattered at a scattering rate of $\frac{1}{3}$ times that of the predetermined scattering rate (450 kg/m$^2$h), that is, at a rate of 150 kg/m$^2$h, for 20 minutes after commencing the scattering of steel balls. Thereafter, steel balls were scattered at a rate of 600 kg/m$^2$h for 40 minutes. The total amount of scattered steel balls was equalized to that in the heretofore known method. In this case, the specific heat transfer performance recovered was equal to that recovered by carrying out the heretofore known method indicated by solid lines in FIG. 6. Nevertheless, the peak concentration of soot in the exhaust gas was about 0.33 times that in the heretofore known method and about 5.1 times as large as that upon the termination of the scattering operation as indicated by dash lines in FIG. 7. In other words, according to the above-described embodiment of the present invention, since the peak concentration of soot in the exhaust gas is remarkably lowered as compared to when the heretofore known method is employed, an electric dust collector having a capacity about $\frac{1}{3}$ of that used in the prior art could suffice. Accordingly, an extremely small-sized and less expensive electric dust collector can be used when the present invention is implemented.

It is to be noted that while the change of the scattering rate of steel balls was performed in two steps in the above-described embodiment of the method according to the present invention, the number of steps can be increased or the scattering rate can instead be changed continuously.

Figure 8:
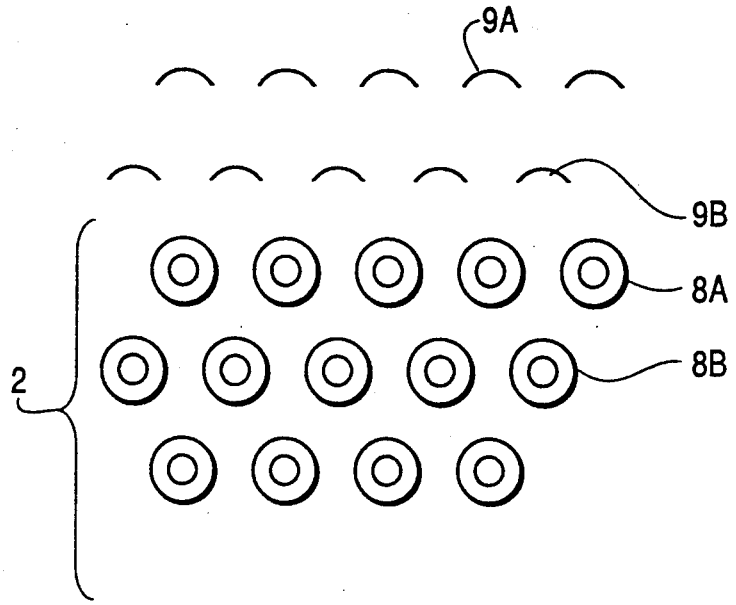
FIG. 8 is schematic transverse cross-sectional view of that portion of a heat exchanger proximate a heat transfer tube group according to a preferred embodiment of the present invention.
Figure 9:
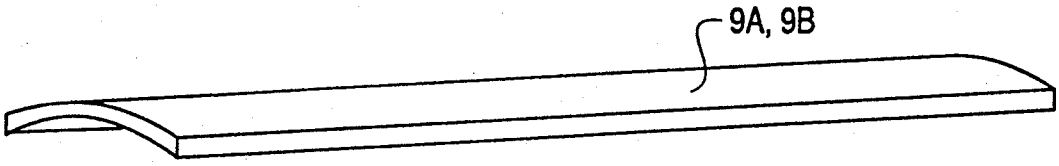
FIG. 9 is a perspective view of a steel ball collision preventing plate of the preferred embodiment.

In the following, a second aspect of the present invention will be described. FIG. 8 is a schematic transverse cross-sectional view of a heat transfer tube group, and FIG. 9 is a perspective view of a steel ball collision preventing plate according to the present invention.

Figure 2:
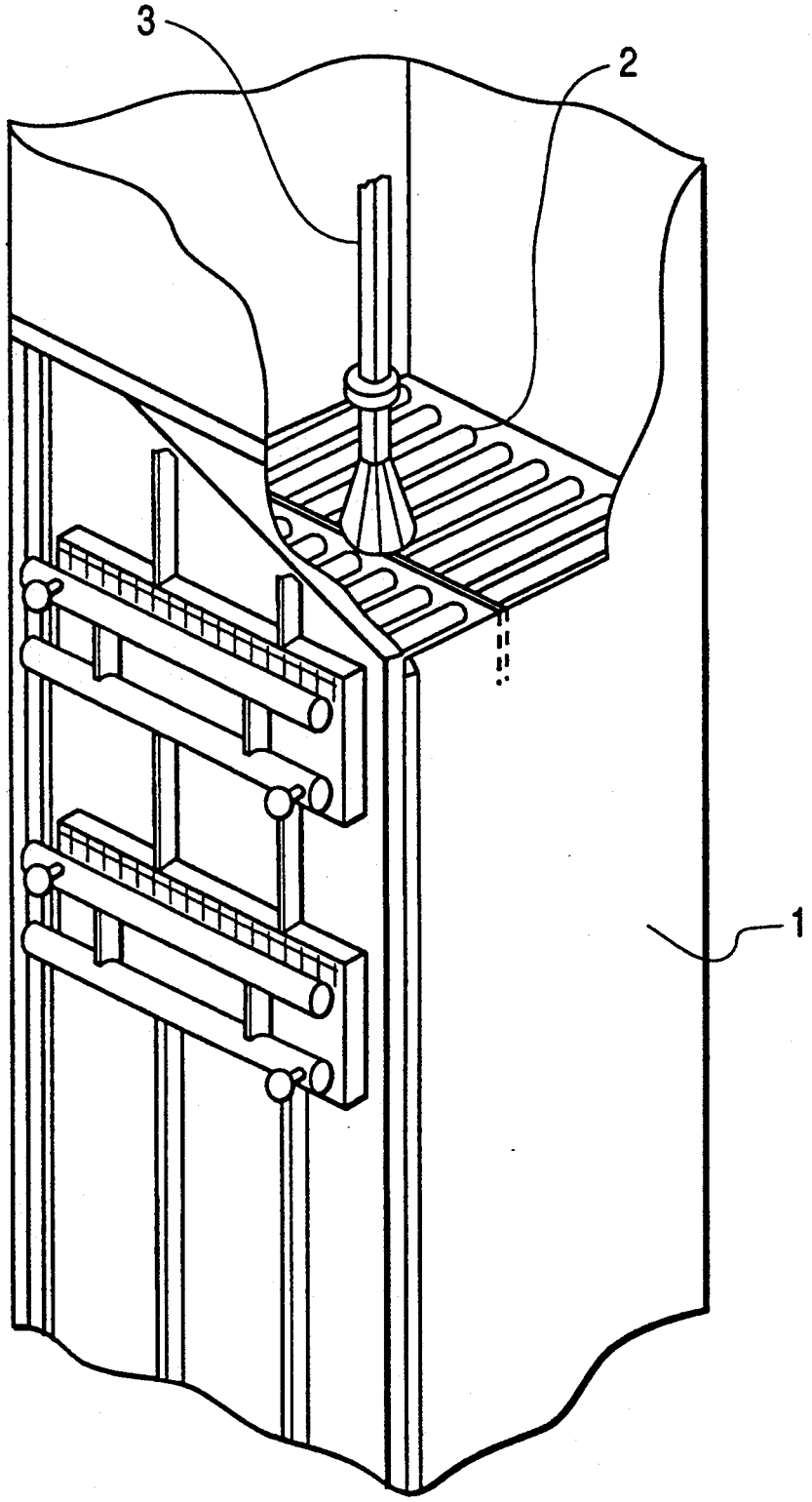
FIG. 2 PRIOR ART
FIG. 2 is a perspective view, partly cut away, of the same heat exchanger in the prior art.
Figure 3:
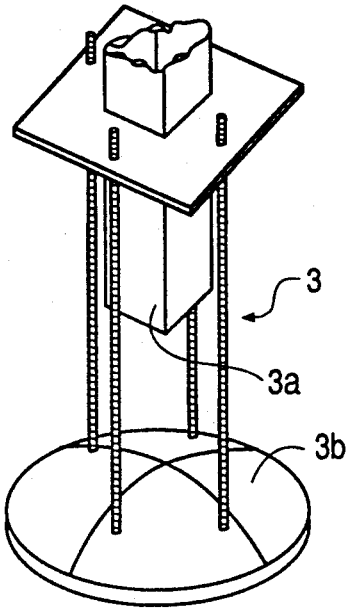
FIG. 3 PRIOR ART
FIG. 3 is a perspective view of a steel ball scatterer in the prior art.

In FIG. 8, reference numeral 2 designates a heat transfer tube group, which comprises a plurality of finned heat transfer tubes 8A, 8B, . . . arranged in a zig-zag manner at a plurality of levels. In the illustrated embodiment, first-level protectors (steel ball collision preventing plates) 9A and second-level protectors 9B are disposed respectively above first-level finned heat transfer tubes 8A and second-level finned heat transfer tubes 8B. Each of these protectors 9A and 9B is a steel plate having an upwardly convex curvature as shown in FIG. 9, and they are arranged so as to cover the finned heat transfer tubes 8A and 8B, respectively, as spaced at a predetermined interval from the finned heat transfer tubes. Although not illustrated, a steel ball scatterer similar to that in the prior art as described above with reference to FIGS. 1 and 2, for example, a steel ball scatterer as illustrated in FIG. 3, is disposed further above the protectors 9A and 9B.

In such an apparatus, steel balls fed through steel ball feeder pipes in the steel ball scatterer fall and collide against a scattering plate and fly and disperse in the circumferential direction thereof. Thus, the steel balls fall towards the heat transfer tube group 2 under the scattering plate. And after they have once collided with the protectors 9A or 9B, they are scattered again. In this way, while undergoing repeated collision and rescattering, the steel balls fall through the heat transfer tube group 2 and thus remove soot and dust adhered to the finned heat transfer tubes 8A, 8B . . .

The force under which a steel ball scattered and dispersed by the steel ball scatterer will impact a fin is weakened when it collides with a protector, so that damage to the fins can be kept to a minimum.

In a dust removing apparatus of the type which employs the scattering of steel balls, the degree of uniformity of the density of scattered steel balls corresponds to the effectiveness of the apparatus to remove dust and consequently to the heat transfer performance of the heat exchanger. Thus, it is desirable to make the scattering density as uniform as possible. On the other hand, because steel balls scattered by a steel ball scatterer do not fall vertically but fall while traveling slightly outwardly if a flat protector is used, the steel balls colliding with the protector would scatter slightly outwardly which could result in the density becoming non-uniform. However, according to the illustrated embodiment, a uniform scattering density can be maintained by employing the upwardly convex collision preventing plates 9A and 9B. It is to be noted that the collision preventing plates can be fabricated of metallic materials such as steel or the like as well as of synthetic high-molecular materials such as RFP or the like, depending upon the expected temperature conditions during use.

Next, results of tests conducted on the preferred embodiment will be described. The test conditions were as follows:

1) Heat transfer tube group: projected cross-sectional area 1 m×1 m
2) Heat transfer tube specification:
   (a) tubes: material STB35, nominal diameter 34 mm, thickness 3.2 mm
   (b) fins : material SPCC, diameter 64 mm, thickness 1.6 mm, pitch 2.5 fins/in
3) Protector specification: material SS41, thickness 3 mm, width 40 mm, radius of curvature 100 mm, disposed 80 mm above and 30 mm above the upper edges of the first level heat transfer tubes.
4) Steel balls: diameter 5 mm
5) Steel ball scattering rate: 5000 kg/cm$^2$h (average scattering height: about 1.3 mm from the heat transfer tubes)

Figure 4:
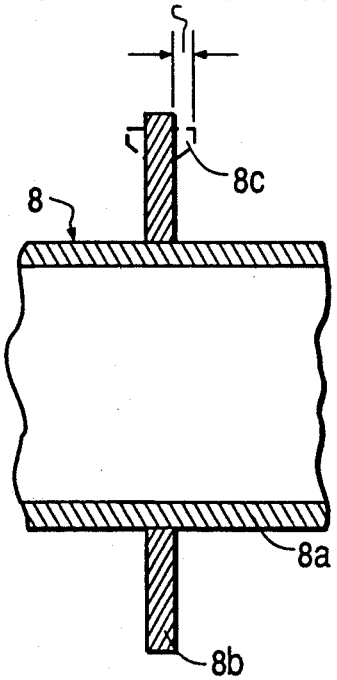
FIG. 4 is a longitudinal cross-sectional view of part of a finned heat transfer tube.
Figure 5:
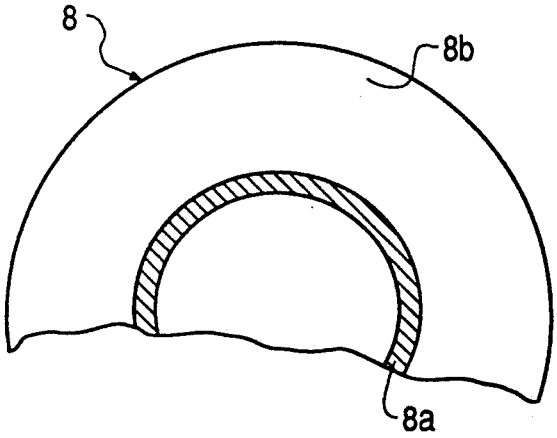
FIG. 5 is a transverse cross-sectional view of the same.
Figure 10A:
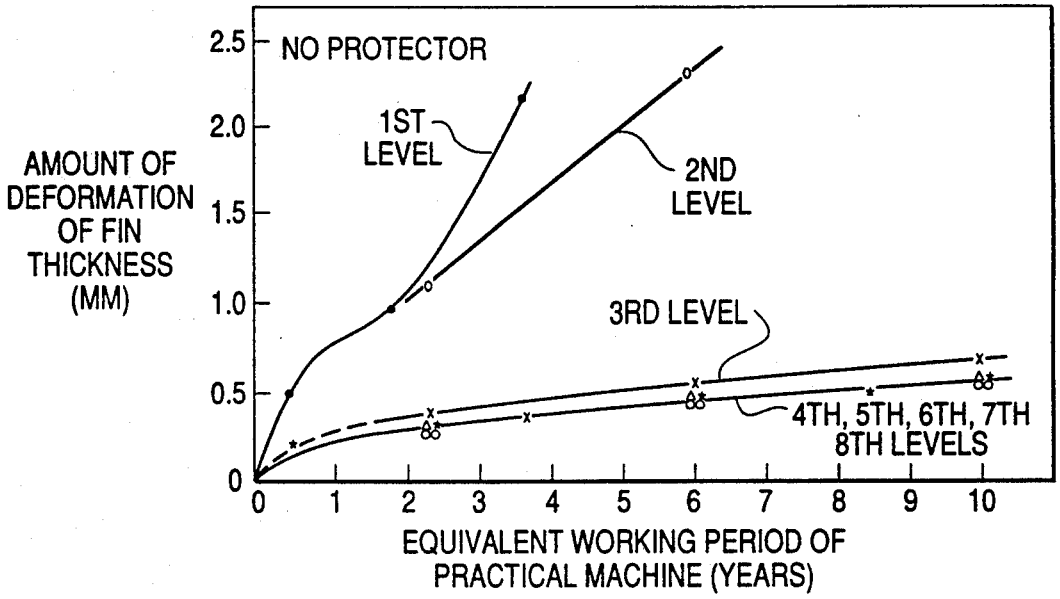
FIGS. 10(*a*) and (*b*) are diagrams illustrating results of tests conducted in connection with examining damaged conditions of fins of heat transfer tubes.
Figure 10B:
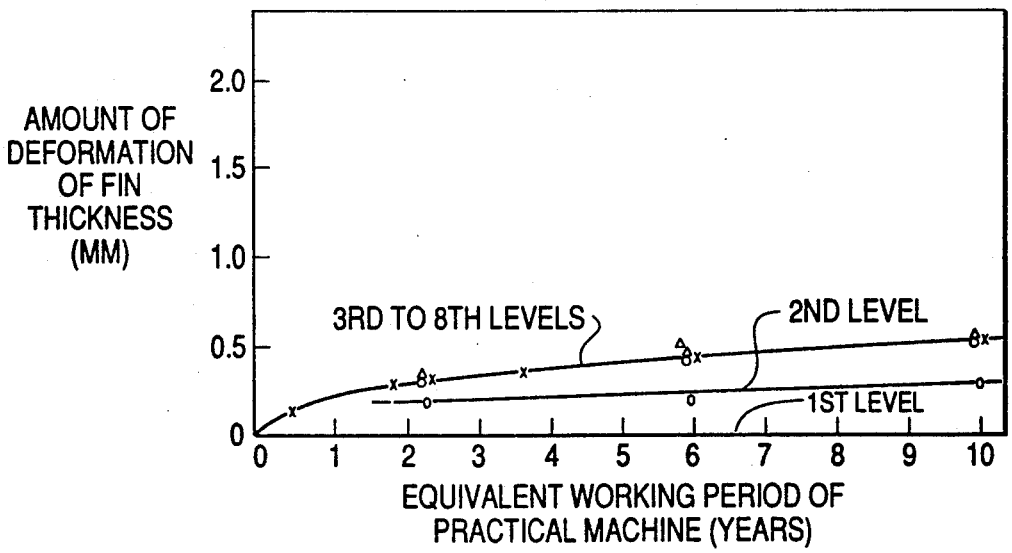
Figure 11:
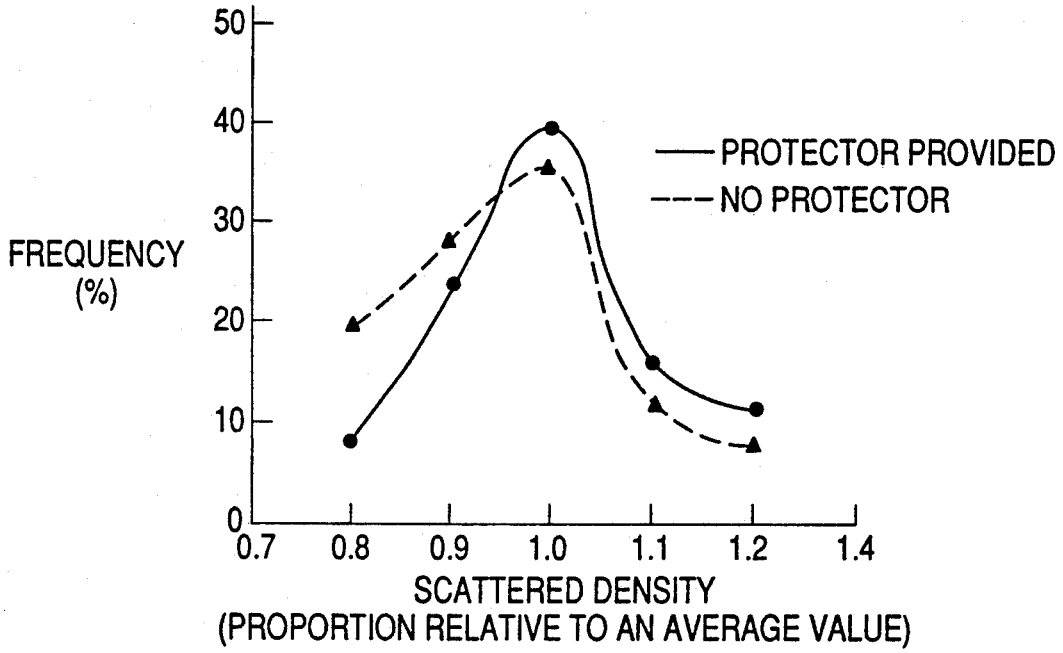
FIG. 11 is a diagram illustrating results of tests conducted in connection with scattered conditions of steel balls.

The results of comparative tests for examining the damage sustained by fins of a heat transfer tube (change in plate thickness at the upper edge portion of the fin 8B shown in FIG. 4) in the case of providing the protectors and in the case of not providing protectors, are shown in FIG. 10. In the case of not providing the protectors, as shown in FIG. 10(*a*), the fins on the heat transfer tubes at the first and second levels are deformed by 1 mm under conditions equivalent to the operation of a practical heat exchanger for about 2 years, and by 1.7–2.3 mm under conditions equivalent to about 4 years of operation. It is to be noted that with respect to the fins on the heat transfer tubes at the third and subsequent levels, even after conditions equivalent to the operation of a practical heat exchanger for about 10 years, a deformation of only 0.65 mm results, which is considered negligible. Whereas, in the case of providing the protectors according to the above-described embodiment of the present invention, as shown in FIG. 10(*b*), after conditions equivalent to the operation of a practical heat exchanger for about 10 years, only a deformation of 0.55 mm or less is observed for all of the heat transfer tubes. Thus, the effectiveness of the protectors according to the present invention has been confirmed.

As will be apparent from the detailed description above, the preferred embodiments of the present invention can bring about the following effects and advantages. That is, when steel balls for removing soot are intermittently scattered towards heat transfer tubes in a heat exchanger, by controlling the rate at which the steel balls are scattered either in a stepwise manner or continuously, an abrupt increase of soot or the like in the exhaust gas can be mitigated.

Accordingly, the space necessary for the installation of peripheral instruments such as, for example, an electric dust collector is fairly small. Accordingly, installation expenses can be saved. In addition, because the soot concentration of the exhaust gas becomes low, the problem of the contamination of the atmospheric air can also be resolved.

Furthermore, according to the present invention, when removing soot and dust adhered to surfaces of heater transfer tubes in a heat exchanger by scattering steel balls towards the heat transfer tubes, the damage to the fins of the heat transfer tubes can be suppressed to a minimum without largely degrading the scattering characteristics of the steel balls. Therefore, the life of the heat transfer tubes can be greatly prolonged.

While a principle of the present invention has been described above in connection with one preferred embodiment of the invention, many apparently widely different embodiments of the present invention could be made without departing from the spirit of the present invention as defined by the appended claims.

What is claimed is:

1. A method for removing soot or the like adhered to heat transfer tubes of a heat-exchanger, said method comprising intermittently scattering steel balls towards said heat transfer tubes during a scattering operation; and controlling the rate at which the steel balls are scattered during said operation in such a manner as to set the rate at the commencement of the scattering operation to a small initial rate and to thereafter cause the rate to increase to one that is substantially greater than said initial rate.

2. A method for removing soot or the like adhered to heat transfer tubes of a heat exchanger, said method comprising: providing a steel ball scatterer above said heat transfer tubes; intermittently scattering steel balls towards said heat transfer tubes with said steel ball scatterer during a scattering operation; and controlling the rate at which the steel balls are scattered during said operation in such a manner as to set the rate at the commencement of the scattering operation to a small initial rate and to thereafter cause the rate to increase to one that is substantially greater than said initial rate.

* * * * *